US010535930B2

(12) United States Patent
Genta et al.

(10) Patent No.: US 10,535,930 B2
(45) Date of Patent: Jan. 14, 2020

(54) ELECTRICAL CONNECTOR WITH A FLEXIBLE SLEEVE

(71) Applicant: Tyco Electronics AMP Italia S.R.L., Turin (IT)

(72) Inventors: Alessandro Genta, Alpignano (IT); Marcello Farinola, Rivoli (IT)

(73) Assignee: TE Connectivity Italia Distribution S.R.L., Turin (IT)

( * ) Notice: Subject to any disclaimer, the term of this patent is extended or adjusted under 35 U.S.C. 154(b) by 0 days.

(21) Appl. No.: 16/025,395

(22) Filed: Jul. 2, 2018

(65) Prior Publication Data

US 2019/0013597 A1 Jan. 10, 2019

(30) Foreign Application Priority Data

Jul. 6, 2017 (IT) ..... 102017000075884

(51) Int. Cl.
*H01R 4/24* (2018.01)
*H01R 4/2404* (2018.01)
*H01R 4/70* (2006.01)

(52) U.S. Cl.
CPC ..... *H01R 4/2404* (2013.01); *H01R 4/70* (2013.01); *H01R 2201/26* (2013.01)

(58) Field of Classification Search
CPC .. H01R 4/2433; H01R 9/0757; H01R 23/025; H01R 2103/00; H01R 9/0521; H01R 9/0518
USPC ..... 439/404, 405, 417, 418, 580–585
See application file for complete search history.

(56) References Cited

U.S. PATENT DOCUMENTS 5,030,143 A * 7/1991 Hatagishi ..... H01R 4/2466 439/395
5,078,618 A * 1/1992 Peloza ..... H01R 13/111 439/439
5,342,226 A * 8/1994 Hayes ..... H01R 13/113 439/845
5,573,434 A * 11/1996 Ittah ..... H01R 13/113 439/839

(Continued)

FOREIGN PATENT DOCUMENTS

EP 1563519 A1 8/2005
EP 3193408 A1 7/2017
WO 200805626 A1 3/2008

OTHER PUBLICATIONS

Italian Search Report, dated Mar. 8, 2018, 8 pages.

*Primary Examiner* — Thanh Tam T Le
(74) *Attorney, Agent, or Firm* — Barley Snyder

(57) ABSTRACT

An electrical connector comprises a contact element capable of being coupled to a support element on which a wire is wound and a flexible sleeve mounted around the contact element to retain the contact element on the support element. The contact element has an inoperative undeformed position in which flexible walls of the contact element are outwardly divergent from one another and, when the contact element is fitted over the support element in the inoperative undeformed position, a cutting element of the contact element remains at a distance from the wire. The flexible sleeve is movable into a final operative position in which the flexible sleeve pushes the flexible walls toward an inwardly inclined position in which the cutting element cuts into the insulating material of the wire and forms an electrical connection with the wire.

17 Claims, 10 Drawing Sheets

(56) References Cited

U.S. PATENT DOCUMENTS

| | | | | |
|---|---|---|---|---|
| 5,868,590 | A * | 2/1999 | Dobbelaere | H01R 13/18 439/839 |
| 6,361,352 | B2 * | 3/2002 | Barrat | H01R 4/2466 439/395 |
| 7,172,471 | B2 * | 2/2007 | Bommersheim | H01R 13/18 439/850 |
| 7,252,559 | B1 * | 8/2007 | Morello | H01R 4/185 439/843 |
| 7,766,706 | B2 * | 8/2010 | Kawamura | H01R 13/112 439/833 |
| 9,011,186 | B2 * | 4/2015 | Wirth | H01R 13/112 439/843 |
| 10,193,247 | B1 * | 1/2019 | Glick | H01R 13/18 |
| 10,230,190 | B2 * | 3/2019 | Frimmersdorf | H01R 13/15 |

* cited by examiner

ELECTRICAL CONNECTOR WITH A FLEXIBLE SLEEVE

CROSS-REFERENCE TO RELATED APPLICATION

This application claims the benefit of the filing date under 35 U.S.C. § 119(a)-(d) of Italian Patent Application No. 102017000075884, filed on Jul. 6, 2017.

FIELD OF THE INVENTION

The present invention relates to an electrical connector and, more particularly, to an electrical connector for connecting a magnetic ignition coil to an internal combustion engine.

BACKGROUND

As is known in the art, an ignition coil is connected to an internal combustion engine having a support element on which a wire is wound. The wire is soldered to the ignition coil after local removal of a layer of insulating varnish covering the wire. However, because of a current trend of continuously reducing the dimensions of the wire, in such a connection the wire can break or electrical contact cannot be made if the wire is not insulated correctly.

An alternative technology for creating a connection to an ignition coil for a combustion engine is disclosed in European Patent Application No. 17150868.2. EP 17150868.2 discloses an electrical connector providing the connection to a magnetic ignition coil for an internal combustion engine without resorting to soldering or welding. The electrical connector in EP 17150868.2, however, has a complex structure and does not guarantee a correct and reliable connection.

SUMMARY

An electrical connector comprises a contact element capable of being coupled to a support element on which a wire is wound and a flexible sleeve mounted around the contact element to retain the contact element on the support element. The contact element has an inoperative undeformed position in which flexible walls of the contact element are outwardly divergent from one another and, when the contact element is fitted over the support element in the inoperative undeformed position, a cutting element of the contact element remains at a distance from the wire. The flexible sleeve is movable into a final operative position in which the flexible sleeve pushes the flexible walls toward an inwardly inclined position in which the cutting element cuts into the insulating material of the wire and forms an electrical connection with the wire.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
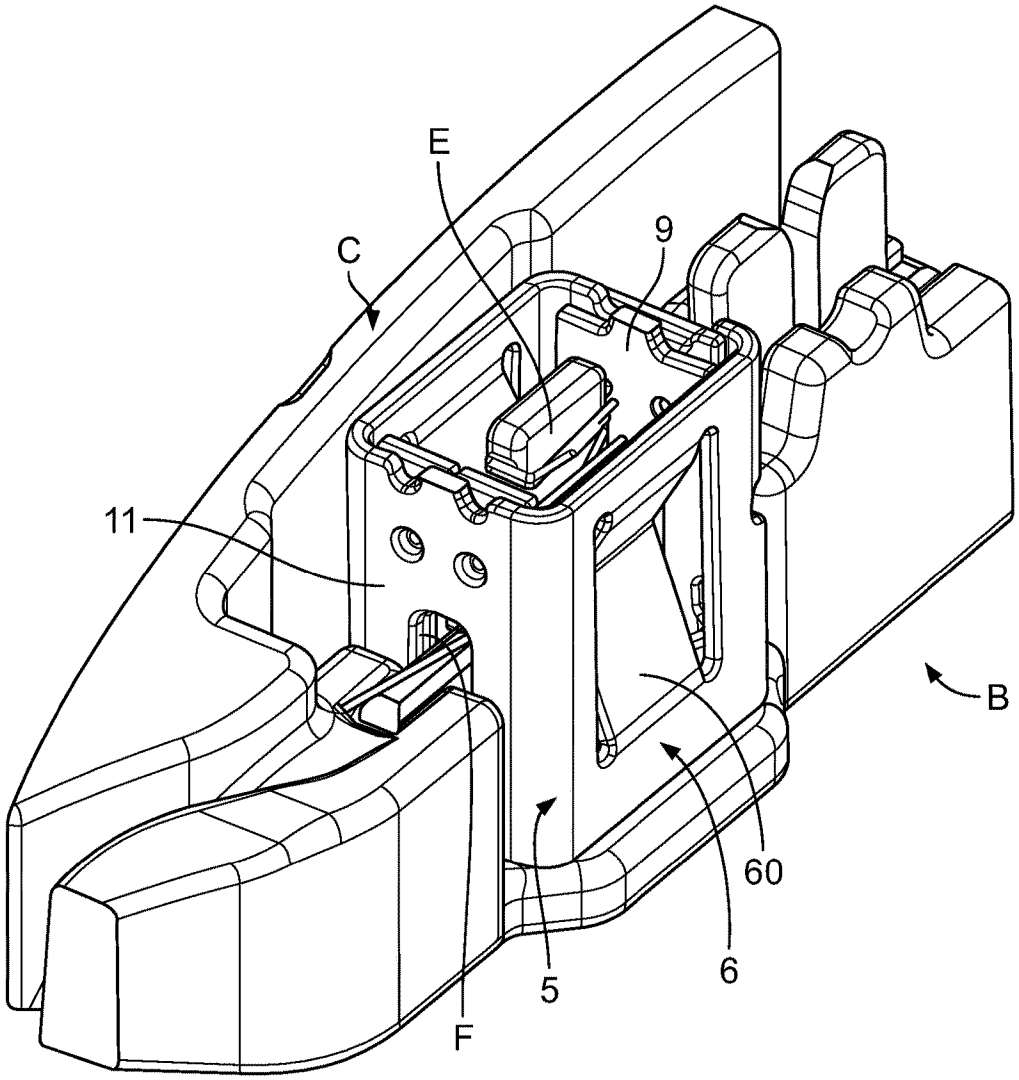
FIG. 1 is a perspective view of an electrical connector according to an embodiment connected to a magnetic ignition coil.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An electrical connector C according to an embodiment is shown in FIGS. 1-8B. The connector C, as shown in the embodiment of FIG. 1, is connected to a magnetic ignition coil B for an internal combustion engine. As shown in FIG. 7C, the magnetic coil B comprises a wire W wound on a support element E of conductive material. The wire W has an insulating material covering and is wound around the support element E to form a plurality of windings A. As is described in greater detail below, the connector C has a structure that brings about an electrical connection between the support element E and the wire W at the windings A by locally removing the layer of insulating material of the wire W.

Figure 2:
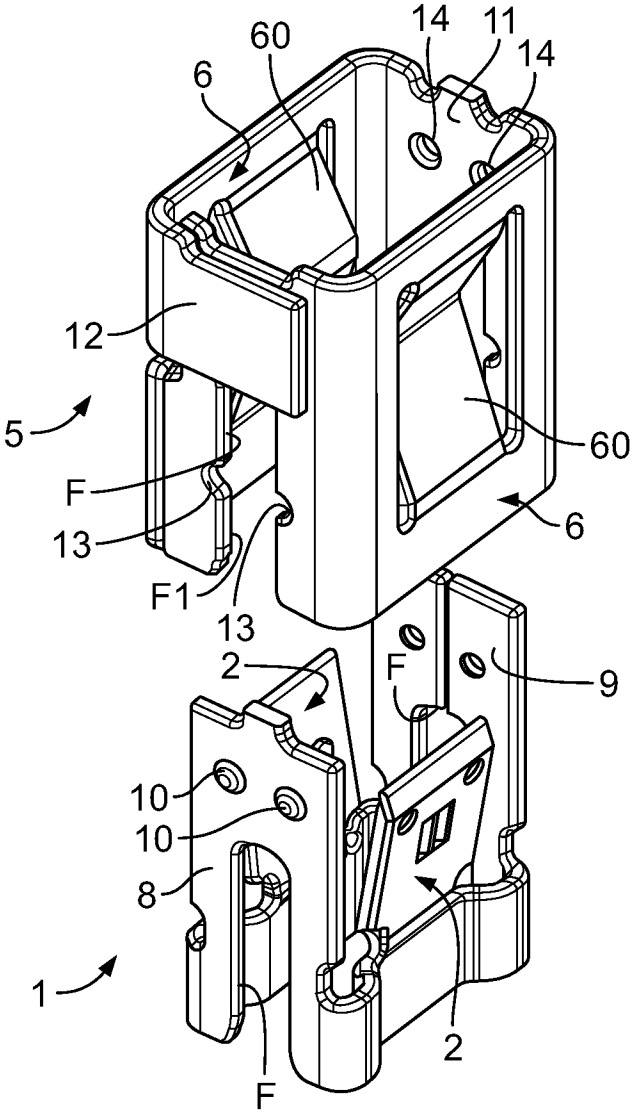
FIG. 2 is an exploded perspective view of the electrical connector of FIG. 1.
Figure 4B:
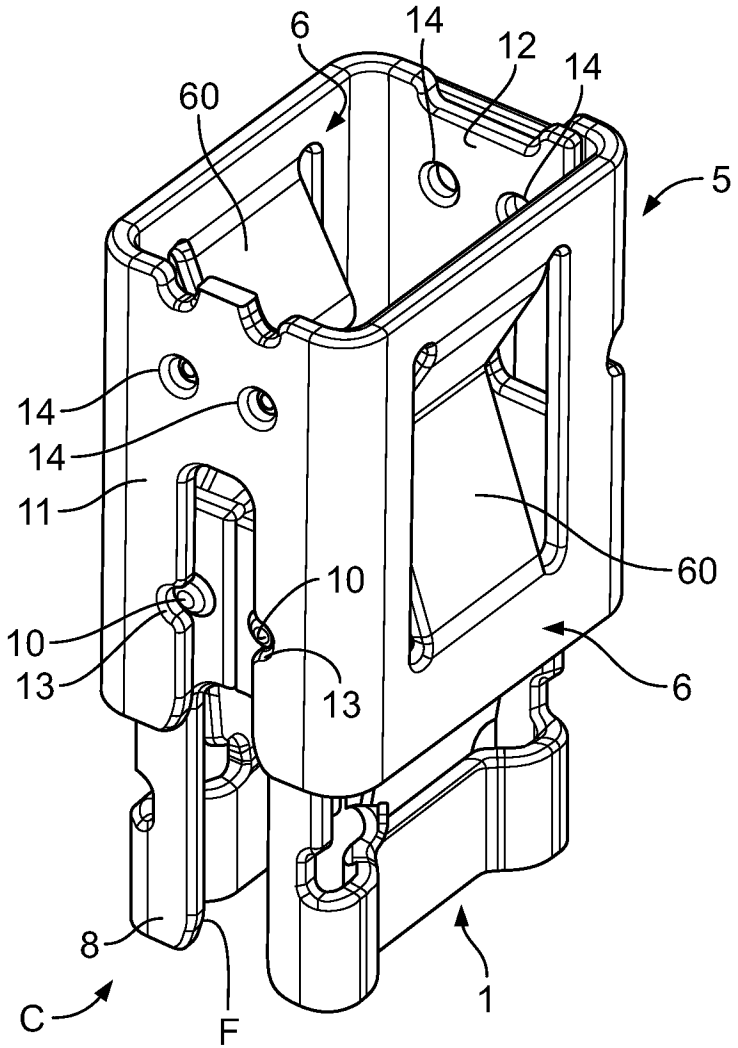
FIG. 4B is a rear perspective view of the electrical connector of FIG. 1 in the pre-locking position.
Figure 4A:
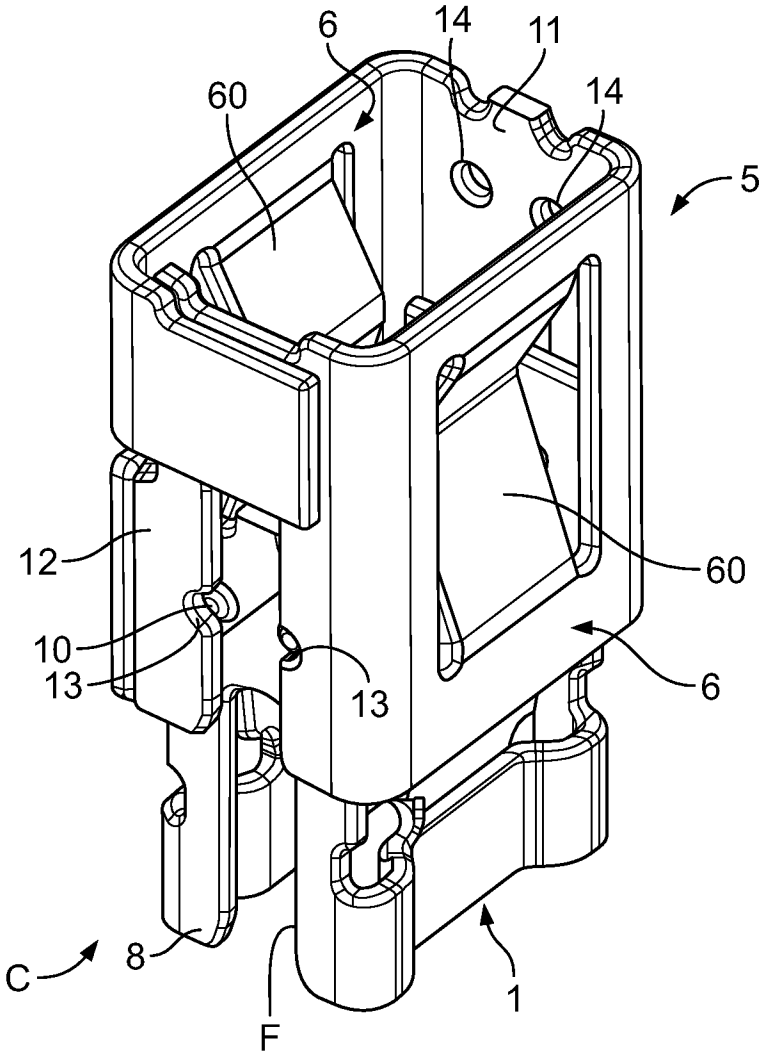
FIG. 4A is a front perspective view of the electrical connector of FIG. 1 in a pre-locking position.
Figure 6A:
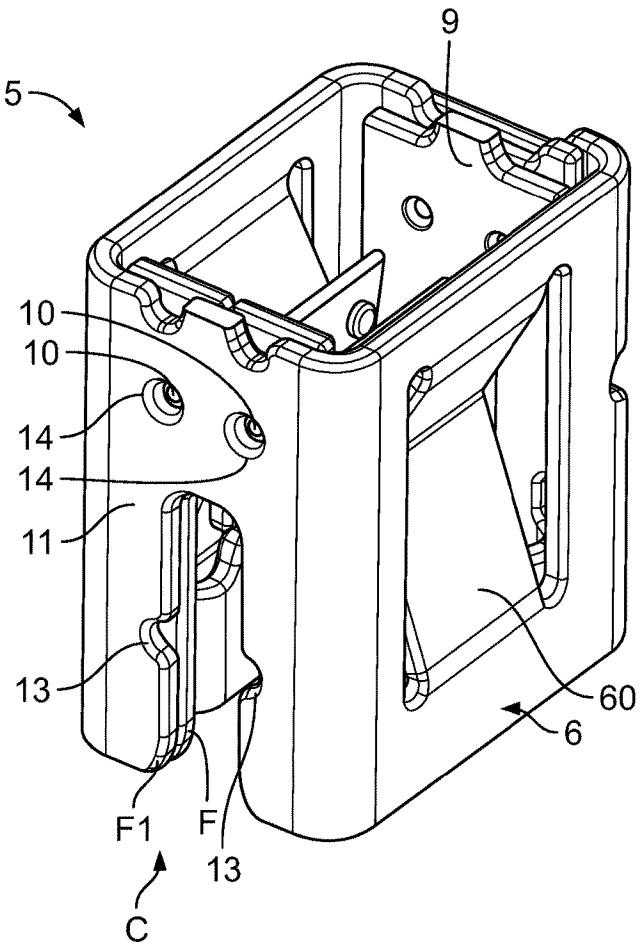
FIG. 6A is a perspective view of the electrical connector of FIG. 1 in a final operative position.
Figure 5:
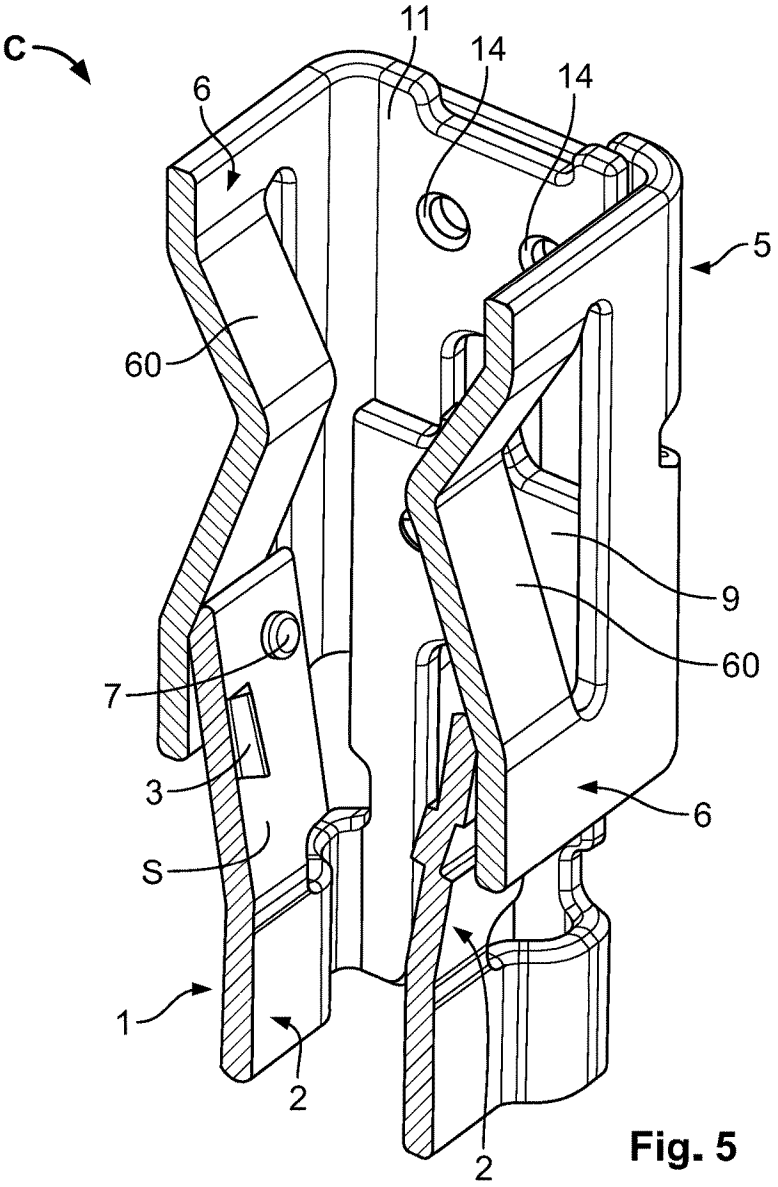
FIG. 5 is a sectional perspective view of the electrical connector of FIG. 1 in the pre-locking position.
Figure 6C:
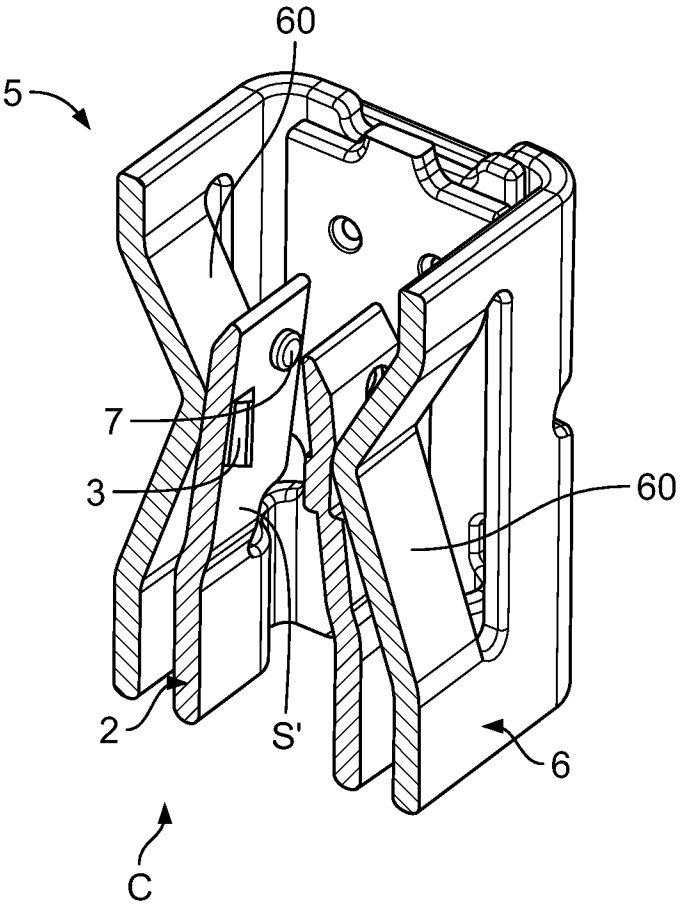
FIG. 6C is a sectional perspective view of the electrical connector of FIG. 1 in the final operative position.
Figure 6B:
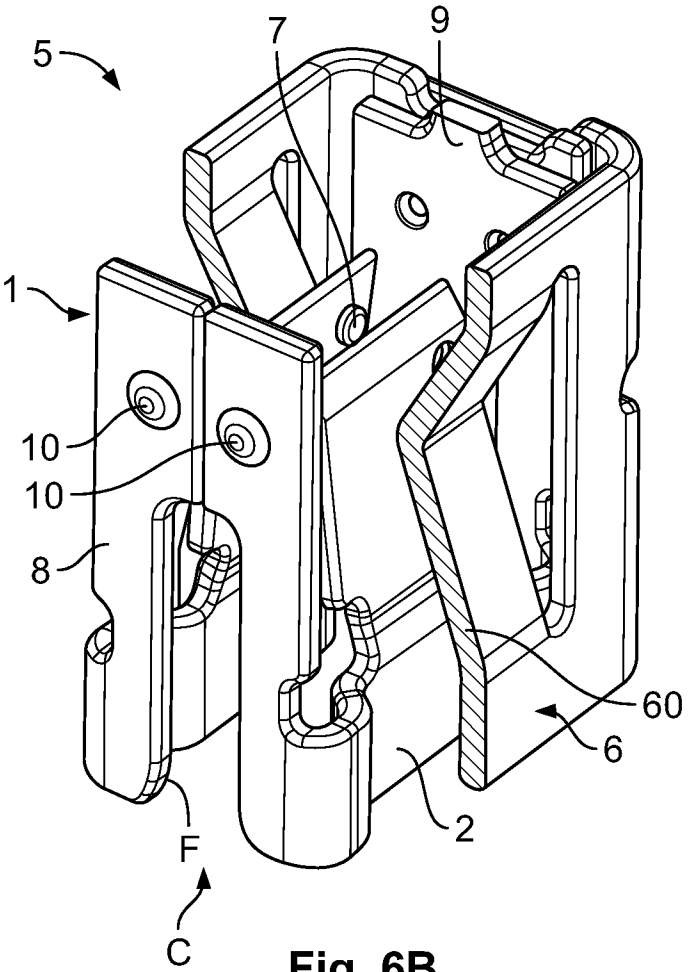
FIG. 6B is a partially sectional perspective view of the electrical connector of FIG. 1 in the final operative position.

The connector C, as shown in FIG. 2, includes a contact element 1 adapted to be positioned over the support element E and a flexible sleeve 5 that is mounted over and around the contact element 1. The contact element 1 and the flexible sleeve 5 both have a quadrilateral body. The flexible sleeve 5 is mounted on the contact element 1 in such a way as to be movable from a preliminary pre-locking position to a final operative position. In the final operative position, the flexible sleeve 5 is arranged around the contact element 1. In an embodiment, the connector C is formed by cutting to size and being a sheet metal plate.

Figure 3:
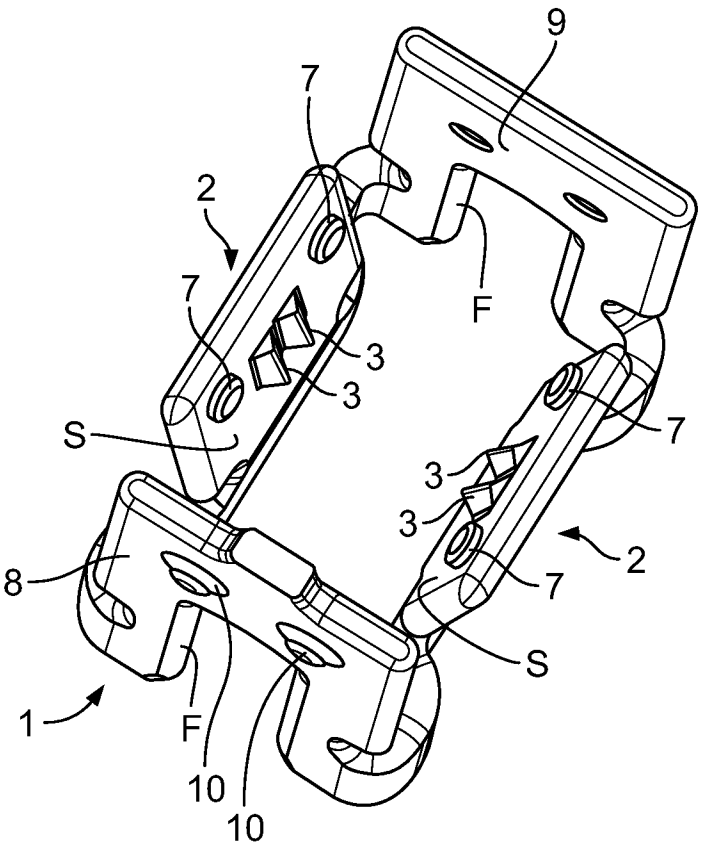
FIG. 3 is a perspective view of a contact element of the electrical connector of FIG. 1.
Figure 7B:
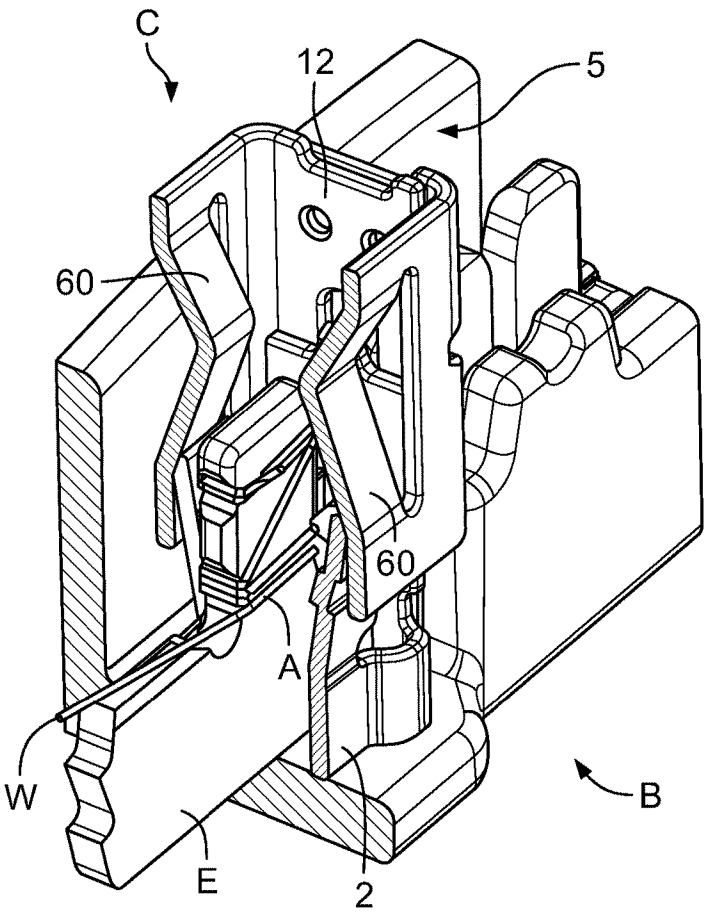
FIG. 7B is a sectional perspective view of the electrical connector of FIG. 1 in the pre-locking position after insertion onto the support element.
Figure 7A:
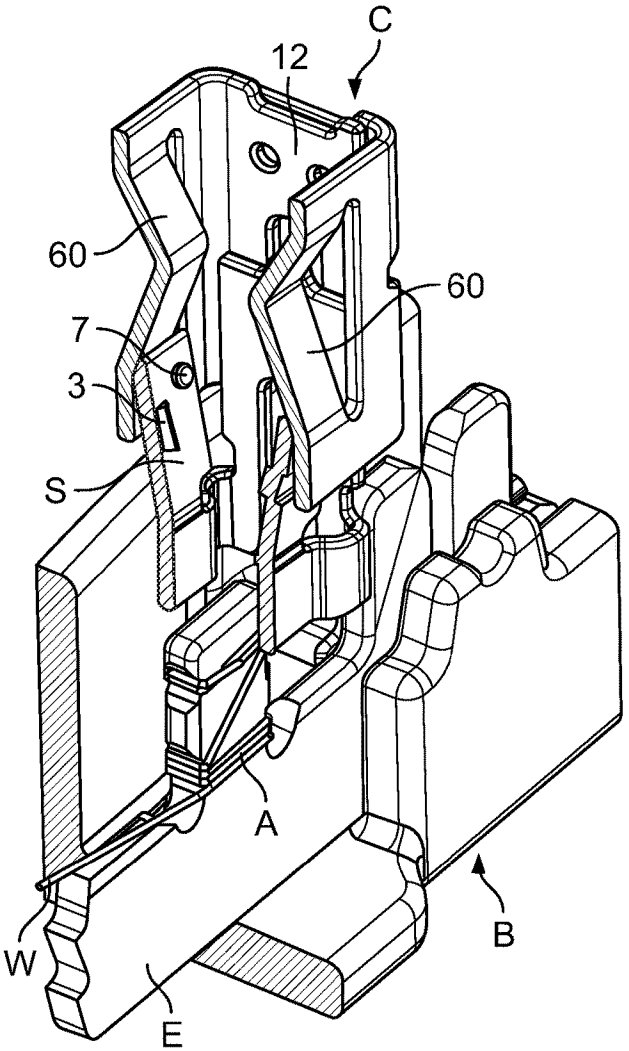
FIG. 7A is a sectional perspective view of the electrical connector of FIG. 1 in the pre-locking position before insertion onto a support element.

The contact element 1, as shown in FIGS. 2 and 3, has two flexible walls 2 which face one another and are adapted to come into contact with the support element E, on which the wire W is wound, only when the flexible sleeve 5 is moved from the preliminary pre-locking position to the final operative position. The contact element 1 has an undeformed inoperative position, shown in FIGS. 2, 3, 5, in which the flexible walls 2 are outwardly divergent from one another. When the connector C is in the inoperative position thereof and is fitted over the support element E, the flexible walls 2 are at a distance from the wire W wound around the support element E, as shown in FIGS. 7A-7B. The connector C is thus configured in such a way that there is no risk of the wire W wound around the support element E being damaged as a result of interference between the flexible walls 2 and the wire W. The connector C can be positioned without special tools which require installation of the connector C on the support element E.

The support element 1, as shown in FIGS. 2 and 3, further comprises a rigid end wall 8 and a rigid base wall 9. The rigid walls 8, 9 are mutually parallel and face one another. Each of the rigid walls 8, 9 has a contact groove F which is situated to prevent interference between the support element E and the contact element 1 when the connector C is coupled to the support element E, as shown in FIG. 1.

The flexible sleeve 5, as shown in FIG. 2, has a quadrilateral body having slightly greater dimensions than the contact element 1. The flexible sleeve 5 is mounted over the contact element 1 and is adapted to be moved into a final operative position in which the sleeve 5 cooperates with the body of the contact element 1 to bring about the connection. The flexible sleeve 5 comprises two lateral walls 6 which face one another and each of which has a central inclined portion 60. The central inclined portions 60 protrude towards the interior in the direction of the support element E and are adapted to cooperate with the flexible walls 2 of the contact element 1 when the flexible sleeve 5 is moved into the final operative position, bringing about the electric contact with the magnetic coil B. In shown embodiment, the central portions 60 have a peaked shape, but any other shape or element may be used as long as it is adapted to push the flexible walls 2 into a position inclined towards the support element E.

As shown in FIG. 3, cutting elements 3 are situated on the flexible walls 2 on the inner surfaces S of the contact element 1 which face towards the support element E. The cutting elements 3 in the shown embodiment are in the form of longitudinal, parallel blades, which are produced for example using a broaching process. In other embodiments, the cutting elements 3 could be formed by milling, plastic deformation, or die-stamping. In the embodiment of FIG. 3, a pair of substantially mutually parallel cutting blades 3 is arranged on both flexible walls 2 of the contact element 1. The cutting elements 3 are situated so as to cut into the insulating material covering of the wire W at the windings A around the support element E when the flexible sleeve 5 is moved from the preliminary pre-locking position thereof to the final operative position therein.

The movement of the flexible sleeve 5 into the final operative position causes the lateral walls 6 thereof, and in particular the central portions 60 thereof, to push the flexible walls 2 of the contact element 1 from the outwardly divergent position thereof to the inwardly inclined position thereof. When this happens, the cutting elements 3 cut into the layer of insulating material of the wire W and come into contact with the internal conductor. In this way, the support element E is placed in electric contact with the wire W via the contact element 1 of conductive material. The current therefore flows in the wire W and, via the cutting elements 3, in the contact element 1, which is in electric contact with the support element E, thus closing the circuit.

To ensure that the flexible walls 2 of the contact element 1 do not bend too much as a result of the pressure exerted by the walls 6 of the flexible sleeve 5, the contact element 1 has at least one end-stop element 7 shown in FIG. 3. The at least one end-stop element 7 is disposed on at least one of the two flexible walls 2 on the internal surface S. The end-stop elements 7 are necessary to ensure that the wire W is not cut by the cutting elements 3 as a result of excessive bending of the flexible walls 2 towards the support element E. The end-stop elements 7 are formed by a pair of protruding circular elements 7 situated on the surfaces S of each flexible wall 2 on an upper portion thereof in the embodiment shown in FIG. 3. In other embodiments, end-stop elements 7 of other shapes and in other locations may be used on the connector C as long as they fulfill the object described above. The end-stop elements 7 and the cutting elements 3 are situated on the surfaces S of the flexible walls 2 such that the cutting elements 3 come into contact with the wire W by cutting into the layer of insulating material and the protruding circular elements 7 come into contact with the support element E on one of the upper ends thereof, as shown in FIGS. 8A-8D.

The mounting of the flexible sleeve 5 over the contact element 1 and the retention of the flexible sleeve 5 in the final operative position around the contact element 1 will now be described in greater detail.

As shown in FIGS. 2 and 3, each of the rigid walls 8, 9 of the contact element 1 has a pair of outwardly protruding pins 10. The pins 10 are situated so as to cooperate with the flexible sleeve 5 positioned over the contact element 1, both in the preliminary pre-locking position and in the final operative position.

The quadrilateral body of the flexible sleeve 5 has two end walls 11, 12 opposite one another which each have two coupling seats 13. The coupling seats 13 are situated so as to receive the protruding pins 10 of the contact element 1 when the flexible sleeve 5 is positioned over the contact element 1 in the preliminary pre-locking position shown in FIGS. 4A and 4B. Each end wall 11, 12 of the flexible sleeve 5 has a pair of passageways 14 situated so as to receive the protruding pins 10 of the contact element 1 when the flexible sleeve 5 is moved into the final operative position adjacent to the contact element 1 and so as to retain the flexible sleeve 5 in the final operative position shown in FIGS. 1, 6A, 6B, and 6C.

Analogously to the walls 8, 9 of the contact element 1, the end walls 11, 12 of the flexible sleeve 5 each have a sleeve groove F1 for preventing the flexible sleeve 5 from interfering with elements external to the connector C when the sleeve 5 is moved into the final operative position. In the shown embodiment, the coupling seats 13 are positioned in the middle of the sleeve groove F1.

Figure 7C:
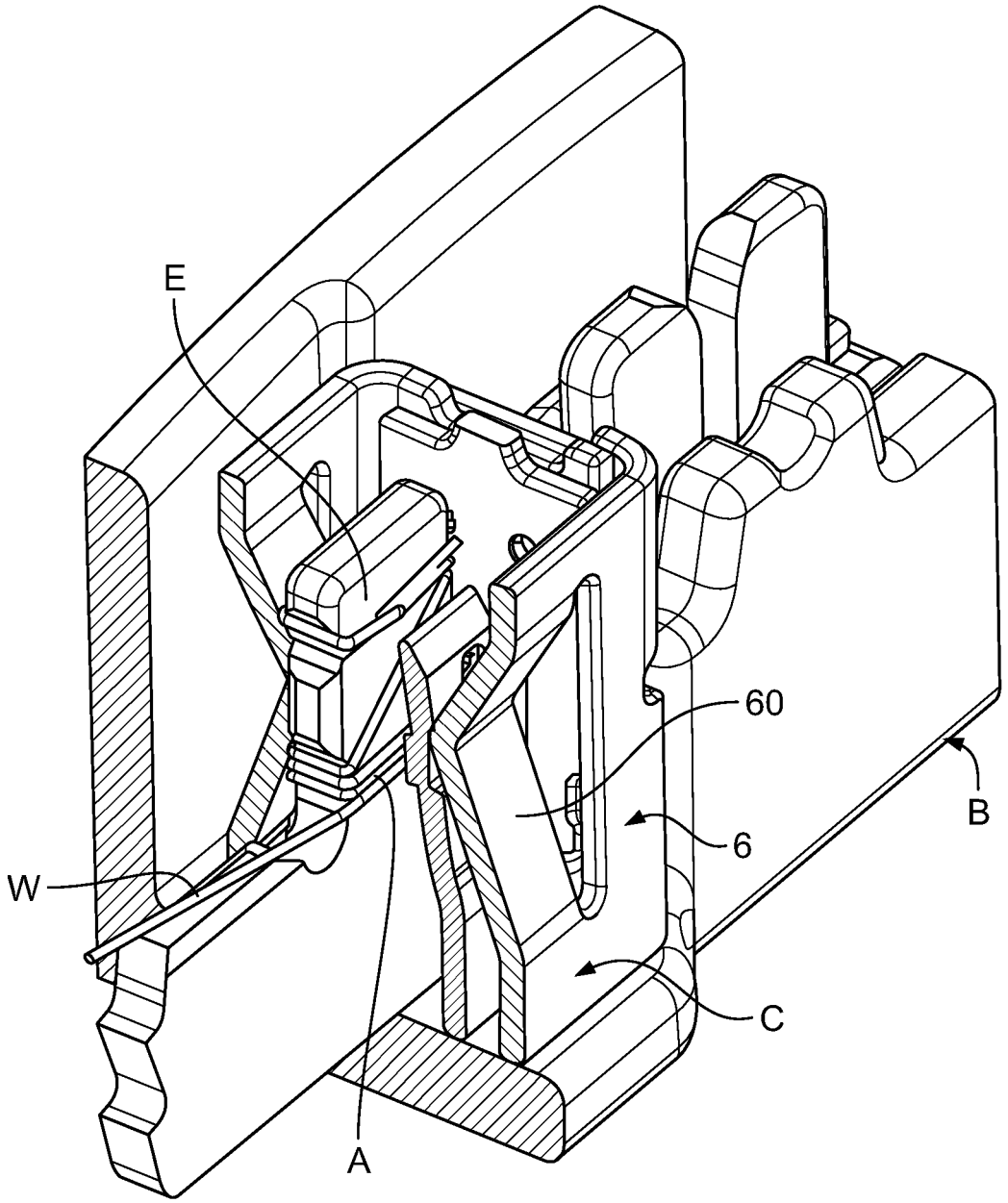
FIG. 7C is a sectional perspective view of the electrical connector of FIG. 1 in the final operative position after insertion onto the support element.

The steps for positioning the connector C on the support element E are shown in FIGS. 7A-7C.

In FIG. 7A, the connector C is in a state in which the contact element 1 is in an inoperative deformed position in which the flexible walls 2 are outwardly divergent from one another and the flexible sleeve 5 is situated over the contact element 1 in the preliminary pre-locking position. The coupling seats 13 of the flexible sleeve 5 are engaged with the pins 10 of the contact element 1.

In FIG. 7B, the connector C is inserted over the support element E by a simple operation which does not require the use of special tools: because the flexible walls 2 are outwardly inclined, it is possible to insert the connector C onto the support element E without risking the cutting elements 3 of the contact element 1 cutting into the wire W.

Figure 8B:
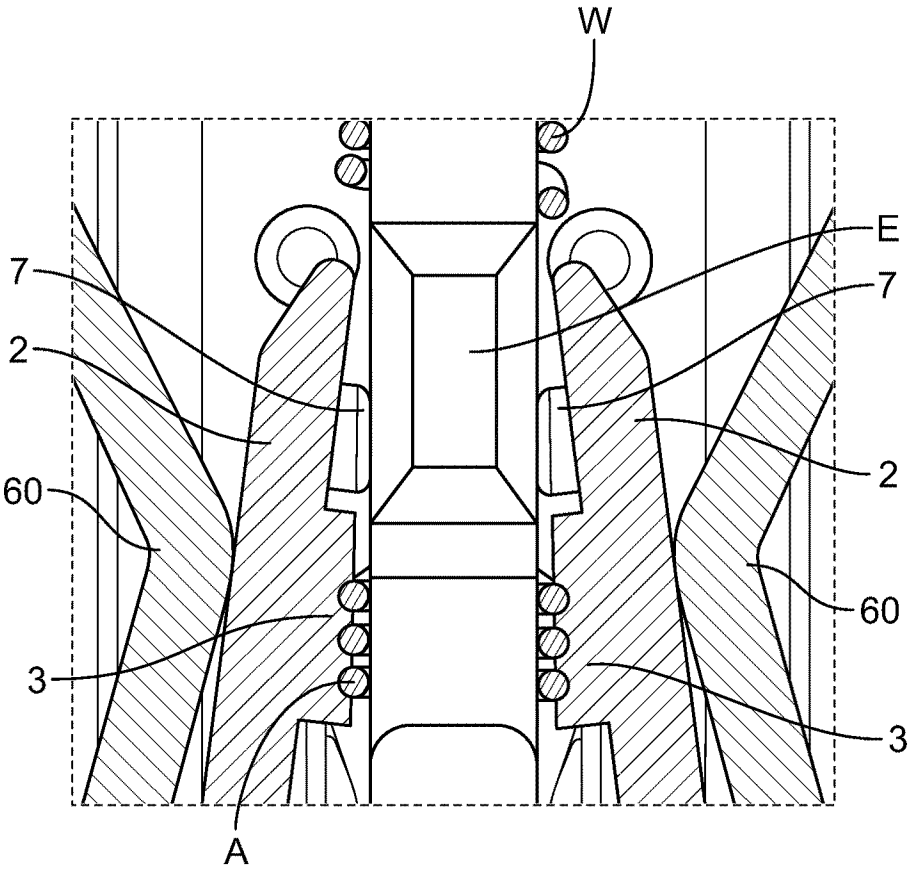
FIG. 8B is an enlarged sectional side view of the electrical connector of FIG. 1 in the final operative position on the support element.
Figure 8A:
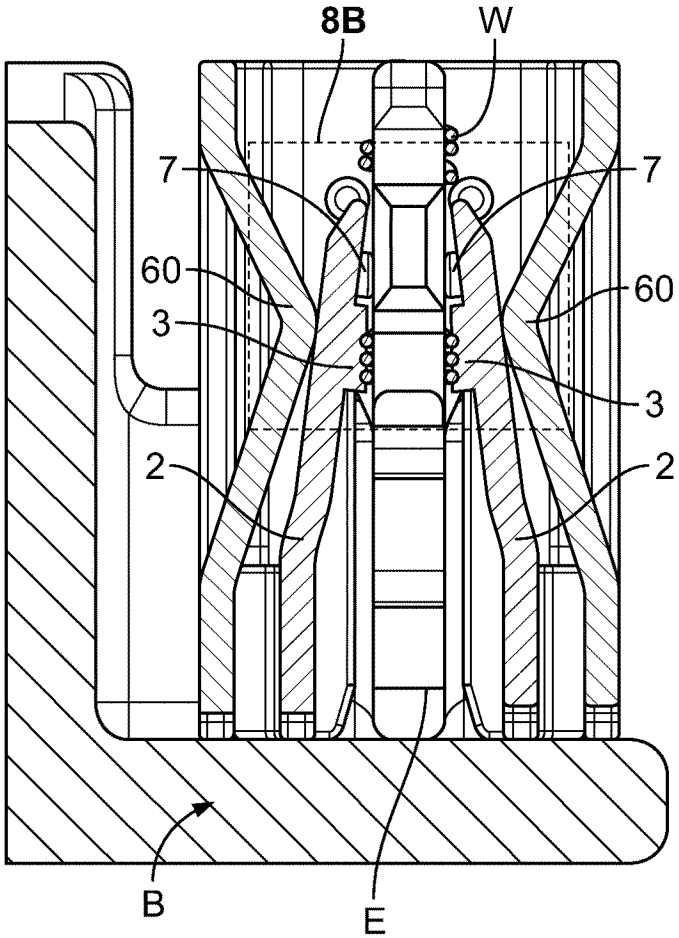
FIG. 8A is a sectional side view of the electrical connector of FIG. 1 in the final operative position on the support element.

In FIG. 7C, the flexible sleeve 5 has been pushed into the final operative position in which the flexible sleeve 5 is disposed around the contact element 1. As a result of the movement of the flexible sleeve 5, simply by pressing, the walls 6 of the flexible sleeve 5, and in particular the portions 60, push the flexible walls 2 of the contact element 1 towards the position inclined towards the support element E. As a result of the bending of the flexible walls 2, the cutting elements 3 situated on the surfaces S of the walls 2 cut into the insulating material covering of the wire W at the windings A and come into electric contact with the wire W, as shown in FIGS. 8A and 8B. The flexible sleeve 5 and in particular the walls 6 thereof exert a continuous pressure on the contact element 1, thus having the function of restraining the contact element 1. The flexible sleeve 5 is retained in the final operative position thereof, in which the body of the flexible sleeve 5 is adjacent to the contact element 1, by the engagement between the pins 10 of the contact element 1 and the passageways 14 in the flexible sleeve 5.

Figure 9:
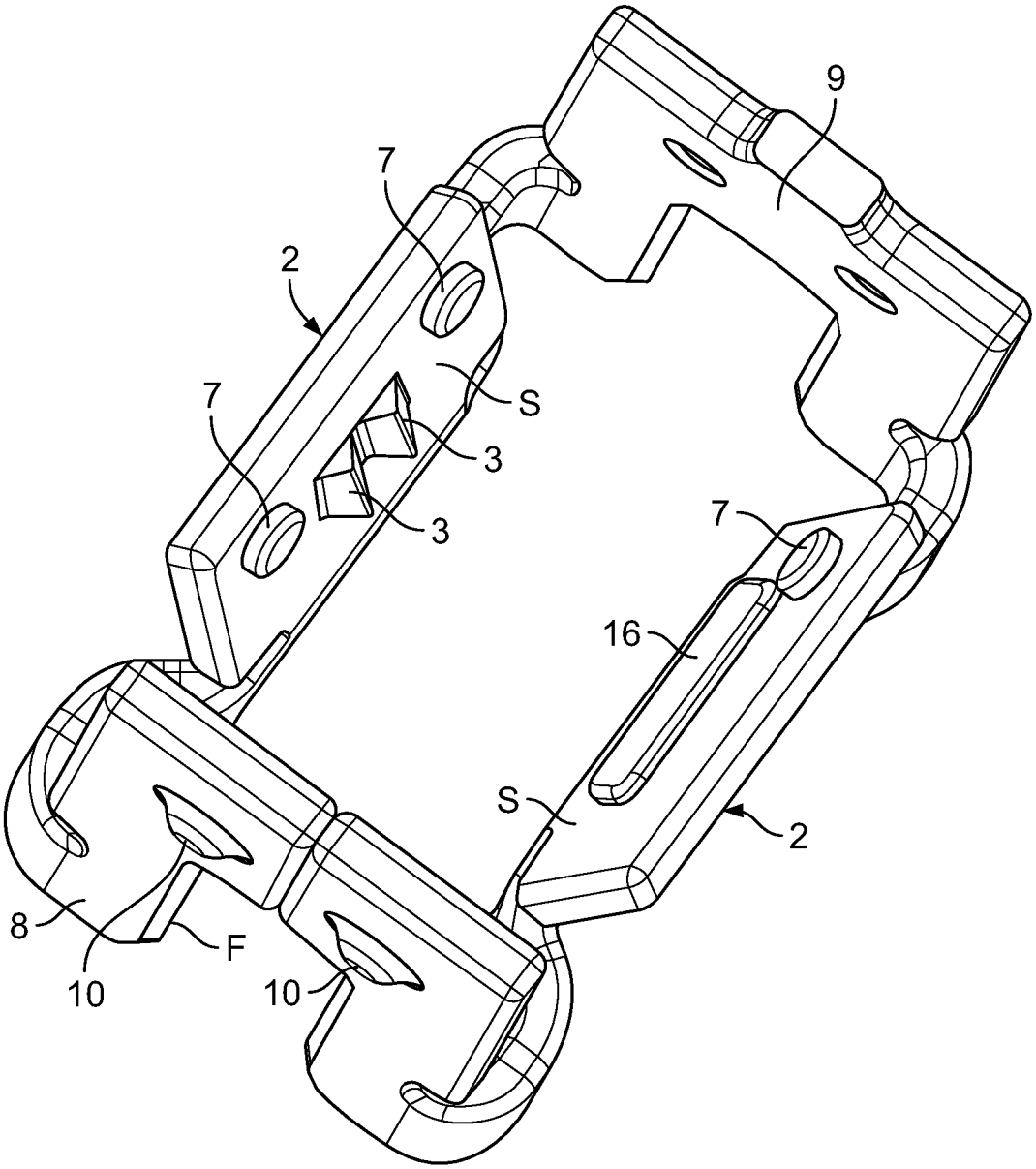
FIG. 9 is a perspective view of a contact element of an electrical connector according to another embodiment.
Figure 10B:
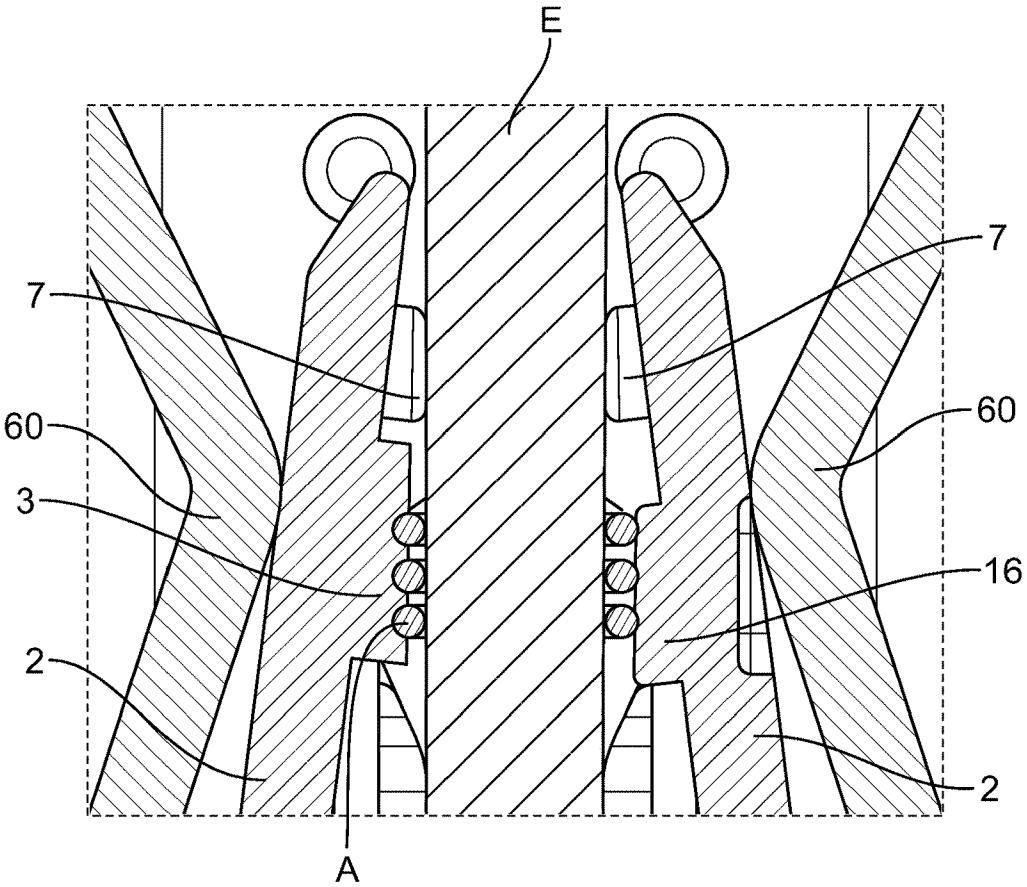
FIG. 10B is an enlarged sectional side view of the electrical connector of FIG. 9 in the final operative position on the support element.
Figure 10A:
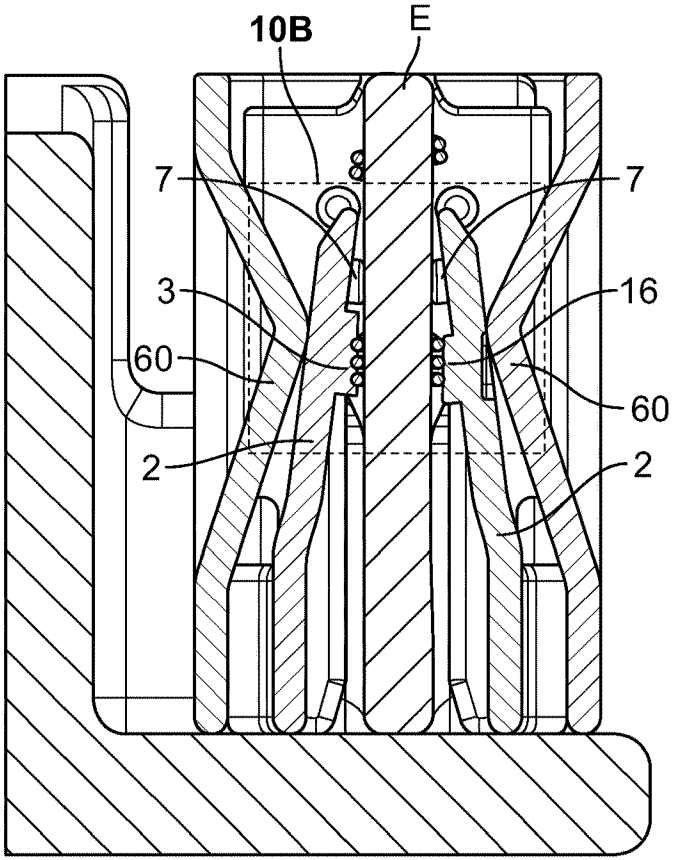
FIG. 10A is a sectional side view of the electrical connector of FIG. 9 in the final operative position on the support element.

An electrical connector C according to another embodiment is shown in FIGS. 9-10B. In the connector C shown in FIGS. 9-10B, only one of the flexible walls 2 of the contact element 1 has a pair of parallel blades 3 and a pair of protruding elements 7. On the opposite flexible wall 2, still on the inner surface S thereof facing the support element E, a protruding portion 16 is situated in place of the cutting elements 3. The protruding portion 16 is adapted to come into contact with the wire W at the windings A of the wire W, as shown FIGS. 10A and 10B, when the flexible sleeve 5 is moved into the operative position. At the protruding portion 16, a single protruding element 7 is provided, which brings about the electric contact between the connector C and the support element E.

The embodiments of the electrical connector C described above make it possible to bring about an effective and reliable connection to the support element E by way of simple and intuitive operations which do not require the use of special tools. Further, the electrical connector C has a structure which is simple in construction, is compact, saves on space, and has low production costs.

What is claimed is:

1. An electrical connector, comprising:

a contact element formed of a conductive material and capable of being coupled to a support element, a wire is wound on the support element, the contact element having:

(a) a pair of flexible walls facing one another and adapted to come into contact with the support element;

(b) a cutting element disposed on an inner surface of at least one of the flexible walls and facing the support element;

(c) an end-stop element disposed on the inner surface of at least one of the flexible walls; and (d) an inoperative undeformed position, the flexible walls are outwardly divergent from one another in the inoperative undeformed position and, when the contact element is fitted over the support element in the inoperative undeformed position, the cutting element remains at a distance from the wire; and a flexible sleeve mounted around the contact element to retain the contact element on the support element, the flexible sleeve positioned above the contact element in a pre-locking position and being movable with respect to the contact element into a final operative position after the contact element has been fitted over the support element, the flexible sleeve in the final operative position pushes the flexible walls toward an inwardly inclined position, the cutting element cuts into the insulating material of the wire and forms an electrical connection with the wire in the inwardly inclined position.

2. The electrical connector of claim 1, wherein the flexible sleeve has a quadrilateral body with a pair of lateral walls facing one another, each of the lateral walls has an inclined central portion.

3. The electrical connector of claim 2, wherein the inclined central portion of each of the lateral walls is adapted to push the flexible walls toward the inwardly inclined position when the flexible sleeve is moved into the final operative position.

4. The electrical connector of claim 3, wherein the contact element has a quadrilateral body with the flexible walls, a rigid end wall, and a rigid base wall, the rigid end wall and the rigid base wall are substantially parallel and face one another.

5. The electrical connector of claim 4, wherein the rigid end wall and the rigid base wall each have a contact groove positioned to prevent an interference between the support element and the contact element when the contact element is coupled to the support element.

6. The electrical connector of claim 5, wherein at least one of the rigid end wall and the rigid base wall has a pair of outwardly protruding pins retaining the flexible sleeve over the contact element.

7. The electrical connector of claim 1, wherein the cutting element is a blade extending in a longitudinal direction of the flexible walls.

8. The electrical connector of claim 7, wherein the end-stop element protrudes toward the support element and is positioned on an upper portion of the inner surface of the at least one flexible wall.

9. The electrical connector of claim 8, wherein a pair of parallel blades and a pair of end-stop elements are disposed on the inner surface of each of the flexible walls.

10. The electrical connector of claim 8, wherein a pair of parallel blades and a pair of end-stop elements are disposed on only a first flexible wall of the pair of flexible walls.

11. The electrical connector of claim 10, wherein a protruding portion adapted to come into contact with the wire is disposed on an inner surface of a second flexible wall of the pair of flexible walls.

12. The electrical connector of claim 11, wherein a protruding element is disposed on the inner surface of the second flexible wall and is adapted to form an electrical connection between the support element and the contact element.

13. The electrical connector of claim 6, wherein the quadrilateral body of the flexible sleeve has a pair of opposite end walls each having a sleeve groove, each of the sleeve grooves has a same dimension as each of the contact grooves.

14. The electrical connector of claim 13, wherein the sleeve grooves are disposed adjacent to the contact grooves in the final operative position and prevent an interference between the support element and the flexible sleeve when the flexible sleeve is moved into the final operative position.

15. The electrical connector of claim 14, wherein the end walls of the flexible sleeve each have a pair of coupling seats, each of the coupling seats receives one of the protruding pins of the contact element when the flexible sleeve is mounted on the contact element in the pre-locking position.

16. The electrical connector of claim 15, wherein the end walls of the flexible sleeve each have a pair of passageways, each of the passageways receives one of the protruding pins of the contact element to retain the flexible sleeve in the final operative position on the contact element.

17. The electrical connector of claim 1, wherein the wire is part of a magnetic ignition coil for an internal combustion engine.

* * * * *